US009109458B2

(12) United States Patent
Alvanos et al.

(10) Patent No.: US 9,109,458 B2
(45) Date of Patent: Aug. 18, 2015

(54) TURBOMACHINERY SEAL

(75) Inventors: Ioannis Alvanos, West Springfield, MA (US); Gabriel L. Suciu, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 753 days.

(21) Appl. No.: 13/294,787

(22) Filed: Nov. 11, 2011

(65) Prior Publication Data

US 2013/0119617 A1 May 16, 2013

(51) Int. Cl.
*F01D 11/00* (2006.01)
*F01D 11/12* (2006.01)

(52) U.S. Cl.
CPC ..... *F01D 11/001* (2013.01); *F01D 11/122* (2013.01); *F01D 11/127* (2013.01); *F05D 2230/64* (2013.01); *F05D 2250/184* (2013.01); *F05D 2260/38* (2013.01)

(58) Field of Classification Search
CPC ..... F16J 15/4474; F16J 15/4476
See application file for complete search history.

(56) References Cited

U.S. PATENT DOCUMENTS 4,285,633 A 8/1981 Jones
5,346,362 A * 9/1994 Bonner et al. ..... 415/191
5,423,659 A * 6/1995 Thompson ..... 415/173.1
5,927,942 A * 7/1999 Stahl et al. ..... 415/115
6,116,852 A * 9/2000 Pierre et al. ..... 415/115
6,129,513 A * 10/2000 Halliwell et al. ..... 415/173.4
6,547,522 B2 4/2003 Turnquist et al.
6,652,226 B2 11/2003 Albrecht, Jr. et al.
7,040,857 B2 5/2006 Chin et al.
7,172,199 B2 2/2007 Rogers
7,287,956 B2 * 10/2007 Bracken et al. ..... 415/173.3
7,291,946 B2 11/2007 Clouse et al.
7,435,049 B2 10/2008 Ghasripoor et al.
7,959,532 B2 6/2011 Suciu et al.
2004/0145251 A1 * 7/2004 Clouse et al. ..... 310/51

OTHER PUBLICATIONS

International search report for PCT/US2012/064456 dated Jul. 30, 2013.

* cited by examiner

*Primary Examiner* — Kristina Fulton
*Assistant Examiner* — L. Susmitha Koneru
(74) *Attorney, Agent, or Firm* — O'Shea Getz P.C.

(57) ABSTRACT

A seal for sealing a rotor of a rotary machine to a stator thereof which circumscribes the rotor and is separated therefrom by a gap comprises a nonrotational sealing element received within an annular slot in the stator and radially translatable with respect thereto, and extending into the gap for sealing to rotational sealing element carried by the rotor. A resilient biasing element received between the nonrotational sealing element and a floor of the slot biases the nonrotational sealing element radially inwardly toward the rotational sealing element and limits radially outward movement of the nonrotational sealing element. A guide extending into said gap from the slot engages the nonrotational sealing element to prevent axial misalignment thereof with the machine's rotor.

16 Claims, 3 Drawing Sheets

TURBOMACHINERY SEAL

BACKGROUND OF THE INVENTION

1. Technical Field

This invention relates generally to rotary machines such as gas turbine engines and particularly to a seal for sealing a rotor of such a machine to a stator therefore.

2. Background Information

It is a common practice to seal the stator of a rotary machine such as a gas turbine engine to a rotor thereof to control the flow of working fluid through the machine. For example, it is a known practice to seal the radially inner ends of flow directing vanes in the stator of a gas turbine engine to the engine's rotor to prevent working fluid flowing through the engine from flowing inwardly around the radially inner ends of such vanes thereby bypassing the flow directing airfoil surfaces of such vanes. It is a challenge to provide seals which will effectively seal a gas turbine engine stator to the rotor thereof under a wide range of operating conditions which the engine experiences. For example, changing rotor speeds result in diametrical rotor expansion and contraction as the rotor speeds increase and decrease under normal operating conditions. Also, changing thermal operating conditions of the engine may result in differential radial expansion and contraction of the stator and rotor due to differing rates of thermal expansion and contraction of the materials employed therein. Accordingly, it will be appreciated that seals which seal the stator to the rotor must accommodate such radial expansion and contraction of the engine rotor and stator due to such variations in thermal and dynamic operating characteristics.

There are several known arrangements for sealing gas turbine engine rotors to stators thereof in a way which will accommodate expansion and contraction of the rotors and stators due to variations in dynamic and thermal operating conditions. For example, it is a known practice to pin a nonrotating component of the seal to the stator and provide the nonrotating seal component and stator with splines to allow that seal component to move radially with respect to the stator in response to changes in thermal and dynamic operating conditions. However, such pinned and spline connections take up a significant amount of room within the engine and may interfere with the optimal handling of working fluid flowing through the engine. Accordingly, arrangements are continually sought for sealing turbomachine (such as gas turbine engine) rotors to the stators thereof in a manner which will accommodate radial expansion and contraction of the rotor and stator due to diverse thermal and dynamic operating conditions in a compact manner which minimizes the space taken up by the seal and the resulting interference by mounting hardware for the seal with the optimal handling of working fluid flow through the machine

SUMMARY OF THE DISCLOSURE

In accordance with the present invention, a seal for sealing a stator of a rotating machine to a rotor thereof circumscribed by the stator and radially separated therefrom by an annular gap is provided with a nonrotating sealing element disposed within a slot in the stator and radially translatable with respect thereto; a resilient biasing element disposed between a floor of the slot and a radially outer portion of the nonrotatable sealing element for accommodating limited radial movement of the nonrotatable sealing element and biasing the nonrotatable sealing element radially inwardly in response to radially outward movement thereof, and a rotatable sealing element carried by the rotor and adapted for sealing to the nonrotatable sealing element. The nonrotatable portion of the seal also includes a guide which is received within the slot and extends radially inwardly from the slot into the gap between the rotor and stator for maintaining the axial alignment of the nonrotatable sealing element with the turbomachine rotor.

DETAILED DESCRIPTION OF THE INVENTION

Figure 1:
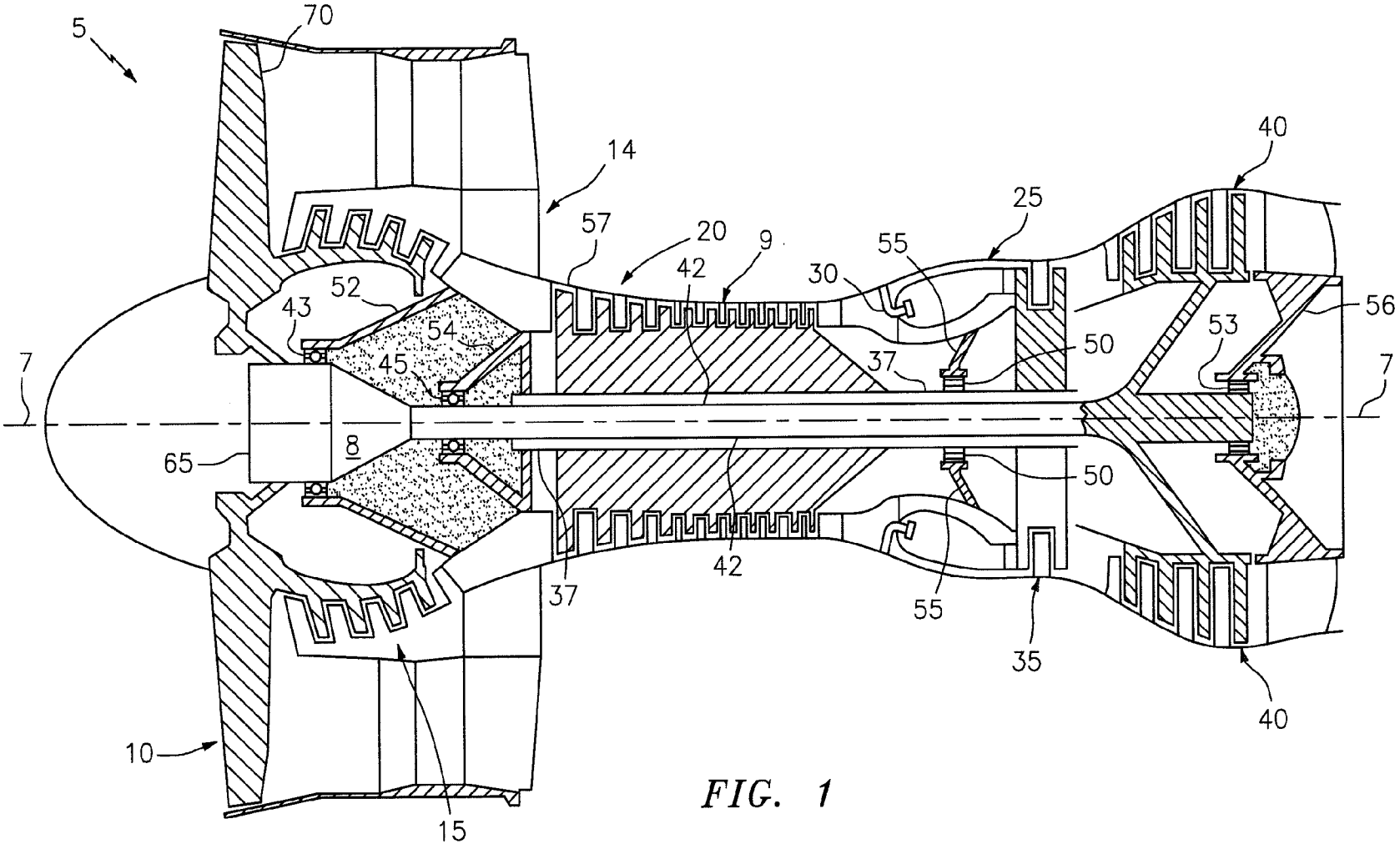
FIG. 1 is a schematic view of a turbofan gas turbine engine of the type employing the seal of the present invention.

Referring to FIG. 1, a turbofan gas turbine engine 5 has a longitudinal axis 7 about which rotors 8 within stator 9 rotate, stator 9 circumscribing the rotors. A fan 10 disposed at the engine inlet draws air into the engine. A low pressure compressor 15 located immediately downstream of fan 10 compresses air exhausted from fan 10 and a high pressure compressor 20 located immediately downstream of low pressure compressor 15, further compresses air received therefrom and exhausts such air to combustors 25 disposed immediately downstream of high pressure compressor 20. Combustors 25 receive fuel through fuel injectors 30 and ignite the fuel/air mixture. The burning fuel-air mixture (working medium fluid) flows axially to a high pressure turbine 35 which extracts energy from the working medium fluid and in so doing, rotates hollow shaft 37, thereby driving the rotor of high pressure compressor 20. The working medium fluid exiting the high pressure turbine 35 then enters low pressure turbine 40, which extracts further energy from the working medium fluid. The low pressure turbine 40 provides power to drive the fan 10 and low pressure compressor 15 through low pressure rotor hub (shaft) 42, which is disposed interiorly of the hollow shaft 37, coaxial thereto. Working medium fluid exiting the low pressure turbine 40 provides axial thrust for powering an associated aircraft (not shown) or a free turbine (also not shown).

Bearings 43, 45, 50 and 53 radially support the concentric high pressure and low pressure turbine shafts from separate frame structures 52, 54, 55 and 56 respectively, attached to engine case 57, which defines the outer boundary of the engine's stator 9. However, the present invention is also well suited for mid-turbine frame engine architectures wherein the upstream bearings for the low and high pressure turbines are mounted on a common frame structure disposed longitudinally (axially) between the high and low pressure turbines.

Figure 2:
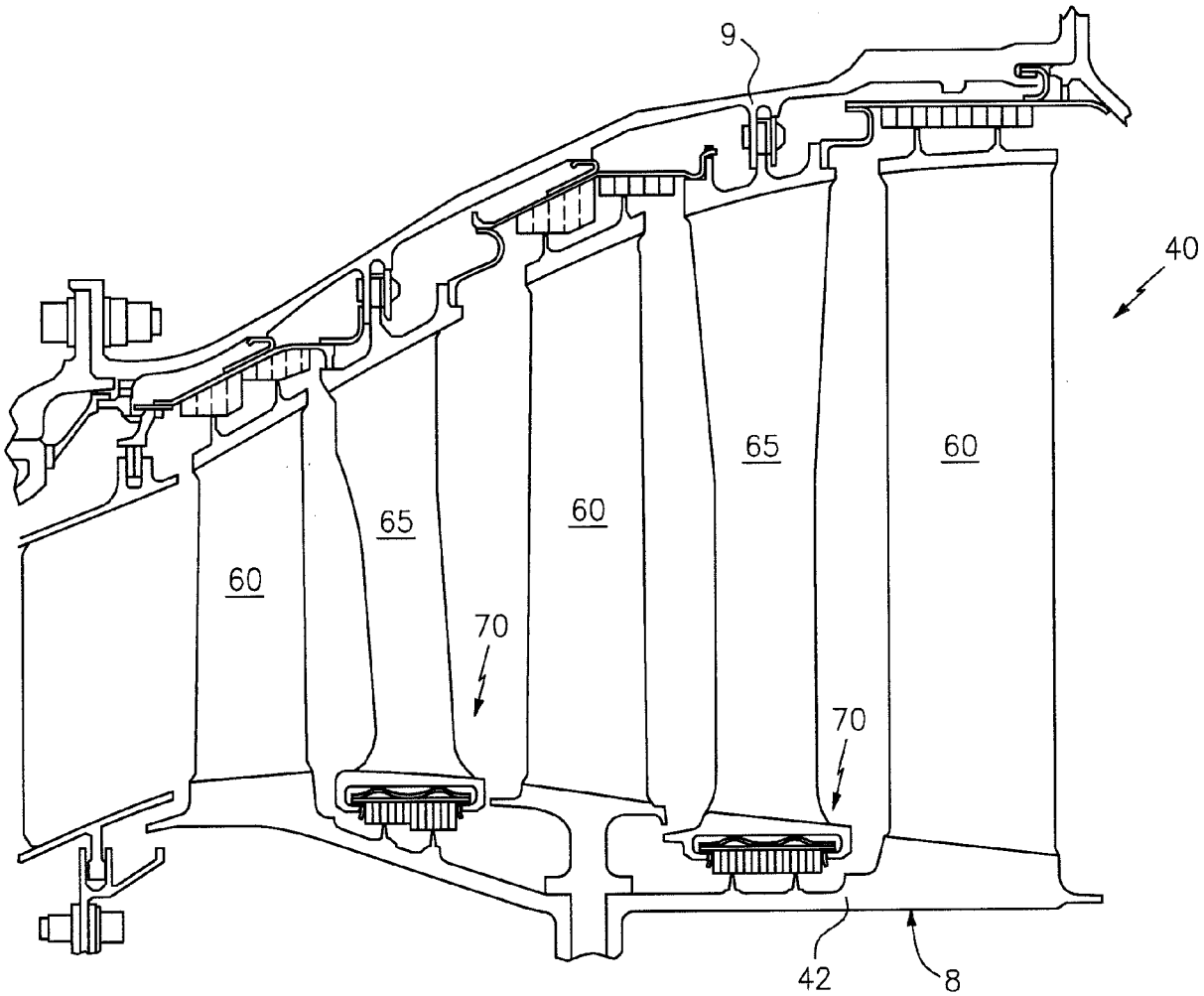
FIG. 2 is a side elevation of a portion of the turbofan gas turbine engine illustrated in FIG. 1, showing the seal of the present invention.

Referring to FIG. 2, a portion of low pressure turbine 40 is shown. Low pressure turbine 40 comprises low pressure turbine rotor hub 42 having a plurality of spaced airfoil blades 60 extending radially outwardly therefrom. Blades 60 interdigitate with a plurality of radially inwardly extending airfoil vanes 65 mounted on stator 9. The vanes 65 are sealed to low pressure turbine rotor hub 42 by seals 70 at the radially inner ends of the vanes to prevent working fluid flowing through the engine from bypassing the airfoil portions of vanes 65 around the radially inner ends of the vanes.

Figure 3:
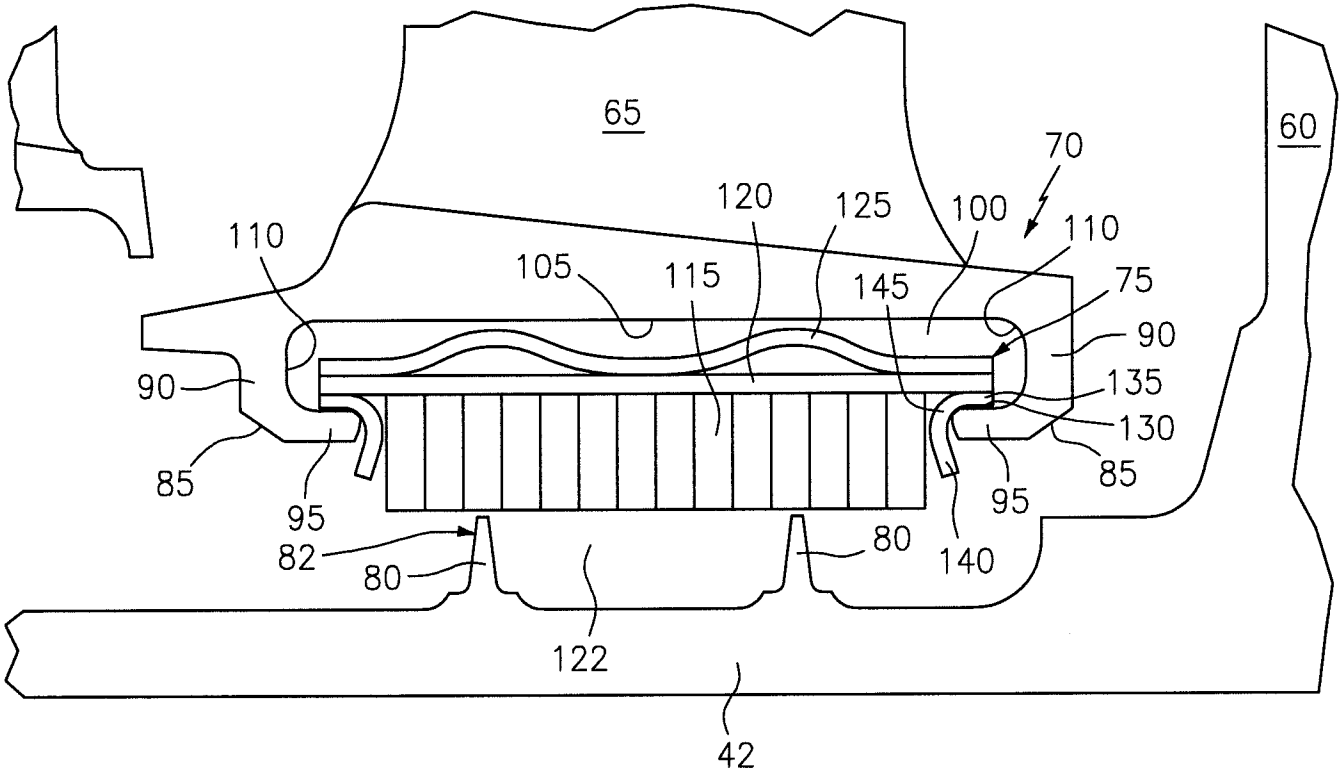
FIG. 3 is an enlarged side elevation of the seal of the present invention illustrated in FIG. 2.

As best seen in FIG. 3, seal 70 comprises a nonrotating portion 75 mounted on the end of vane 65 and a rotating portion 80 mounted on low pressure turbine rotor hub 42.

Still referring to FIG. 3, the radially inner end of vane 65 is provided with a pair of opposed hooks 85, each comprising a radially inwardly extending leg 90 and an axially extending flange 95. The interiors of hooks 85 define a slot 100 having a radially outer floor surface 105 joining a pair of side surfaces 110, each of which comprises an inner surface of one of the hook legs and an adjacent radially outer surface of one of the hook flanges.

Nonrotating portion 75 of seal 70 comprises an annular (or annularly segmented) nonrotating seal element 115 such as a honeycomb element or equivalent, fixed to a backing plate 120. A radially outer portion of nonrotating sealing element 115 is accommodated within slot 100. A radially inner portion of nonrotating sealing element 115 extends through the opening of slot 100 into annular gap 122 between the engine rotor and stator. Nonrotating sealing element 115 is narrower than the width of slot 100 whereby nonrotating sealing element 115 may radially translate within slot 100 in response to radial expansion and contraction of the engine rotor and stator due to changes in thermal and dynamic operating conditions of the engine.

A resilient biasing element such as wave spring 125 is disposed between radially outer floor surface 105 of slot 100 and backing plate 120, wave spring 125 accommodating the aforementioned radial translation of nonrotating sealing element 115 and biasing the sealing element radially inwardly in response to radially outward movement thereof due to the aforementioned radial expansion of rotor 8 in response to thermal and dynamic operating conditions of the engine.

Nonrotating portion 75 of seal 70 also includes a guide 130 including radially outer portion 135 disposed between an edge of backing plate 120 and the radially outer surface of flange 95, a radially inner portion 140 which extends radially inwardly from slot 100 into annular gap 122 and a medial portion 145 which joins radially outer and inner portions 135 and 140 of guide 130 around the free edge of flange 95. It will be appreciated that any tilting of nonrotating seal element 115 due to engine rotor imbalances or other anomalies in the engine operation which would otherwise result in axial misalignment of nonrotating sealing member 115 with rotor 8 will result in engagement of the side surfaces of nonrotating sealing element 115 with the medial portions of guide 130 thereby preventing further misalignment of the nonrotating sealing element with the engine's rotor.

The rotatable portion 80 of seal 70 comprises a pair of axially spaced knife edge seals mounted on hub 42. In a manner well-known in the art, when the engine's rotor and stator are initially assembled, knife edge seals 80 contact nonrotational sealing element 115 so that upon start up, the annular edges of knife edge seals 80 abrade grooves in the radially inner surface of nonrotational sealing element 115. Thereafter, as rotor 8 rotates, knife edge seals 80 will be accommodated within the abraded grooves in nonrotational sealing element 115 so that rotor 8 may rotate with respect thereto without any frictional engagement between knife edge seals 80 and nonrotational sealing element 115.

From the foregoing, it will be appreciated that the rotary machine seal of the present invention effectively seals a rotor to a stator of a rotary machine such as a gas turbine engine in a compact and effective manner. The ability of the nonrotational seal element to radially translate within the stator groove allows the seal to effectively seal the rotor to the stator in spite of radial expansions and contractions of the rotor and stator due to changing thermal and dynamic operating characteristics of the machine. The resilient biasing element maintains the nonrotating sealing element in an optimal radial location with respect to the engine's rotor. The guide effectively maintains the axial alignment of nonrotational sealing element with the axis of the engine's rotor.

Although the present invention has been described in the context of a low pressure turbine section of a gas turbine engine, it will be appreciated that the seal of the present invention may be employed with equal utility in any of a variety of rotating machinery. Furthermore, it will be understood that various modifications to the preferred embodiment described herein may be made without departing from the present invention. For example, while the resilient biasing element has been shown and described as a wave spring, it will be appreciated that various other biasing elements may be employed with equal utility. For example, elastomeric biasing elements or springs of various other shapes and configurations may be employed in the seal of the present invention. Likewise, while nonrotating sealing element 135 has been described as a honeycomb element, it will be appreciated that other forms of a nonrotating sealing element may be employed with equal utility. Accordingly, it will be understood that these and various other modifications to the preferred embodiment illustrated and described herein may be made without departing from the present invention and it is intended by the appended claims to cover any such modifications as fall within the true spirit and scope of the invention herein.

Having thus described the invention, what is claimed is:

1. A seal for sealing an annular gap between a rotor and a stator, said seal comprising:

a nonrotatable sealing portion disposed within an annular slot in said stator, said annular slot opening onto said annular gap, said nonrotatable sealing portion comprising a sealing element having a radially outer portion disposed within said slot and radially translatable with respect thereto, and a radially inner portion extending radially inwardly into said annular gap, said radially inner portion sealing at least one rotational sealing element carried by said rotor, said slot formed in part by flanges that each have an outer radial surface and an inner radial surface;

said nonrotatable sealing portion further comprising a resilient biasing element disposed between a floor of said annular slot and said radially outer portion of said nonrotatable sealing element, said resilient biasing element accommodating and limiting radial movement of said non-rotatable sealing element and biasing said nonrotatable sealing element radially inwardly in response to radially outward movement of said nonrotatable sealing element, said non-rotatable portion further comprising:

at least one guide having:

a radially outer portion received within said annular slot that is disposed between an edge of a backing plate and the outer radial surfaces of said flanges, and a radially inner portion extending radially inwardly from said annular slot into said annular gap, extending beyond said inner radial surfaces of said flanges, and engageable by a side surface of said nonrotatable sealing element for maintaining axial alignment of said nonrotatable sealing element with said rotor.

2. The seal of claim 1 wherein said nonrotatable sealing element is abradable by contact with said rotatable sealing element.

3. The seal of claim 2 wherein said nonrotatable sealing element comprises a honeycomb member.

4. The seal of claim 1 wherein said biasing element comprises a wave spring.

5. The seal of claim 1 wherein said seal is included in a gas turbine engine including a plurality of radially inwardly extending vanes mounted on said stator and interdigitated with a plurality of blades mounted on said rotor, said annular slot being disposed within a radially inner end of one of said vanes.

6. The seal of claim 5 wherein said vane is a low pressure turbine vane.

7. The seal of claim 1 wherein said stator includes a pair of hooks, each of said hooks comprising a radially inwardly extending hook leg and one of the flanges configured as an axially extending hook flange disposed at a radially inner end of said hook leg, said annular slot including a pair of sidewalls, each of said sidewalls comprising an inner surface of one of said hook legs and an adjacent radially outer surface of one of said hook flanges.

8. The seal of claim 7 wherein said radially outer portion of said guide is disposed between a side surface of said nonrotatable sealing element and said radially outer surface of said hook flange.

9. The seal of claim 8 wherein said hook flange includes a free edge and said guide includes a medial portion joining said radially inner and outer portions, said medial portion of said guide extending around said free edge of said hook flange and being engageable by one of said sidewalls of said nonrotatable sealing element for maintaining said axial alignment of said non-rotatable sealing element with said rotor.

10. The seal of claim 9 wherein said nonrotatable seal element is provided at a radially outer surface thereof with said backing plate, said backing plate having forward and aft edge portions, said radially outer portion of said guide being disposed between one of said edge portions of said backing plate and said radially outer surface of said hook flanges.

11. The seal of claim 1 wherein said seal is included in a gas turbine engine.

12. The seal of claim 11 wherein said gas turbine engine stator comprises a plurality of radially inwardly extending vanes, said annular slot being disposed in a radially inner end of one of said vanes.

13. The seal of claim 1 wherein said rotational sealing element comprises an annular knife edge seal having a radially outer edge, said non-rotatable sealing element sealing to said rotational sealing element along said radially outer edge thereof.

14. The seal of claim 1 wherein said annular slot and said non-rotatable sealing element are annular.

15. A seal for sealing an annular gap between a rotor and a radially inner end of a gas turbine engine vane, said seal comprising:

a nonrotatable sealing element disposed within a slot disposed within said radially inner vane end, said slot opening onto said annular gap;

said radially inner end of said vane including a pair of hooks, each of said hooks comprising a radially inwardly extending hook leg and an axially extending hook flange having an outer radial surface and an inner radial surface, said slot including a radially outer floor and a pair of sidewalls, each of said sidewalls comprising an inner surface of one of said hook legs and an adjacent radially outer surface of one of said hook flanges;

said non-rotatable sealing element having a radially outer portion disposed within said slot and a radially inner portion extending radially inwardly between said hook flanges into said annular gap, said radially inner portion of said non-rotatable sealing element sealing at least one rotational sealing element carried by said rotor;

a resilient biasing element disposed between said floor of said slot and said radially outer portion of said non-rotatable sealing element, said resilient biasing element accommodating and limiting radial movement of said non-rotatable sealing element and biasing said non-rotatable sealing element radially inwardly in response to radially outward movement of said non-rotatable sealing element; and a guide having a radially outer portion disposed between an edge of a backing plate and a radially outer surface of at least one of said hook flanges, said guide also having a radially inner portion extending radially inwardly from said slot into said annular gap and beyond said inner radial surface of each hook flange for maintaining axial alignment of said non-rotatable sealing element with said rotor, said guide including a medial portion between said radially inner and outer portions of said guide, said medial portion of said guide extending around a free edge of said hook flange and being engageable by a sidewall of said non-rotatable sealing element for maintaining said axial alignment of said non-rotatable sealing element with said rotor.

16. A gas turbine engine, comprising:

a stator having an annular slot formed in part by flanges that each have an outer radial surface and an inner radial surface;

a rotor that is rotatable relative to said stator;

a seal for sealing an annular gap between said stator and said rotor, said seal comprising:

a nonrotatable sealing portion disposed within said annular slot in said stator, said annular slot opening onto said annular gap, said nonrotatable sealing portion comprising a sealing element having a radially outer portion disposed within said annular slot and radially translatable with respect thereto, and a radially inner portion extending radially inwardly into said annular gap, said radially inner portion sealing at least one rotational sealing element carried by said rotor;

said nonrotatable sealing portion further comprising a resilient biasing element disposed between a floor of said annular slot and said radially outer portion of said nonrotatable sealing element, said resilient biasing element accommodating and limiting radial movement of said non-rotatable sealing element and biasing said non-rotatable sealing element radially inwardly in response to radially outward movement of said nonrotatable sealing element, said non-rotatable portion further comprising:

at least one guide having:

a radially outer portion received within said annular slot that is disposed between an edge of a backing plate and the outer radial surfaces of said flanges, and a radially inner portion extending radially inwardly from said annular slot into said annular gap, extending beyond said inner radial surfaces of said flanges, and engageable by a side surface of said nonrotatable sealing element for maintaining axial alignment of said nonrotatable sealing element with said rotor.

* * * * *